United States Patent [19]

Strongwater

[11] 4,349,102

[45] Sep. 14, 1982

[54] PACKAGING DEVICE

[76] Inventor: Murray Strongwater, 326 Hewlett Neck Rd., Woodmere, N.Y. 11598

[21] Appl. No.: 233,580

[22] Filed: Feb. 11, 1981

[51] Int. Cl.[3] ..... B65D 75/56; B65D 25/54

[52] U.S. Cl. ..... 206/45.34; 206/461; 206/806

[58] Field of Search ..... 206/45.34, 806, 461, 206/462, 203, 193, 45.33, 467; 220/94 R

[56] References Cited

U.S. PATENT DOCUMENTS 3,025,958 3/1962 Snape ..... 206/461

3,380,575 4/1968 Hennessey ..... 206/45.34

*Primary Examiner*—William T. Dixson, Jr.

*Attorney, Agent, or Firm*—Henry R. Lerner

[57] ABSTRACT

A packaging device comprising a pair of shells adapted to be assembled into closing engagement to define an enclosure for an article of merchandise. A hanger element is releasably securable to the packaging device, extending through a slot defined in the upper part thereof. The hanger element includes means to prevent displacement or removal thereof when the two shells are assembled. The hanger element can be dispensed with leaving the packaging device essentially unblemished, whereby the packaging device can be selectively used with or without the hanger element.

3 Claims, 8 Drawing Figures

PACKAGING DEVICE

BACKGROUND OF THE INVENTION

This invention relates to a packaging device for articles of merchandise and has particular application to merchandise such as gloves, the manner of display of which is an important factor in the saleability thereof.

A common way of displaying gloves being offered for sale is to place such gloves in a package provided at the upper end thereof with an integral hanger element so that the packages can be hung on a hook appropriately provided on a display stand. This enables the potential customer to readily remove the package from the hook and to examine and inspect the same.

Packages of this type are usually made of transprent polyethylene with a cardboard backing or insert to impart rigidity thereto, with the gloves being visible through the transparent polyethylene.

Gloves which are somewhat more expensive are usually sold in boxes made of rigid plastic, usually transparent, but such boxes do not have provision for suspending the same from a hook on a display stand. Boxes of this type are therefore usually placed in racks especially designed to hold these boxes in stacked relationship.

It therefore becomes necessary for a glove manufacturer to decide in advance how his goods are going to be displayed. He must either provide packages with a hanger element so that they can be suspended on a display stand or put his merchandise in boxes which have no provision for allowing these to be suspended.

Once the manufacturer has made his decision, the retailer has no choice left but to display the merchandise in the manner compelled by the packaging format. This often is unacceptable to the retailer who must either settle for less than what he would like or, much to the injury of the manufacturer, decline to buy the merchandise.

It is the purpose of the present invention to provide a novel packaging device which overcomes the problems pointed out above, such packaging device being either suspendable from a hook by the incorporation of a hanger element or used without the hanger element and essentially unblemished.

SUMMARY OF THE INVENTION

In accordance with the present invention there is provided a packaging device consisting of a pair of shells adapted to be assembled together in closing engagement to define a closed compartment within which an article of merchandise is stored for the purpose of being displayed and sold. When the two shells are assembled, a small slot is defined at the upper end of the package, which slot is relatively innocuous and totally unnoticeable. Accordingly, the package in such condition is perfectly adapted to be displayed in racks, in the conventional manner.

When it is desired to display the packaging device by suspending the same from a hook on a display stand, there is provided a hanger element which is easily and releasably securable to the packaging device when the two shells are assembled. More specifically, the hanger element comprises a vertically extending hook shaped portion, secured to a base extending generally in a horizontal plane, which hook shaped portion passes through said slot leaving the base disposed on the underside of the slot. In order to secure the hanger element in position on the packaging device, the hook shaped portion is provided with a small projection, vertically spaced from the base, which is disposed above the slot. Each shell comprises a main body portion and a peripheral skirt. A cutout is provided in the upper central region of each shell and these cutouts define the slot when the shells are assembled into closing engagement.

The shells as well as the hanger element are molded of transparent plastic and the same molding operation can provide the elements which define the entire packaging device, namely the two shells and the hanger element.

Thus the packaging device in accordance with the invention permits the retailer, at his option, to display the products in the manner deemed preferable to him. If he wishes to display the products suspended on a display rack, he needs only to assemble the hanger element onto the shells. If he wishes to display his articles unsuspended, he will not utilize the hanger elements and will be left with an attractive box differing only from conventional boxes by the presence of a narrow slot which is however totally unnoticeable and in no way interferes with the aesthetic overall appearance of the packaging device.

DESCRIPTION OF THE PREFERRED EMBODIMENT OF THE INVENTION

Figure 1:
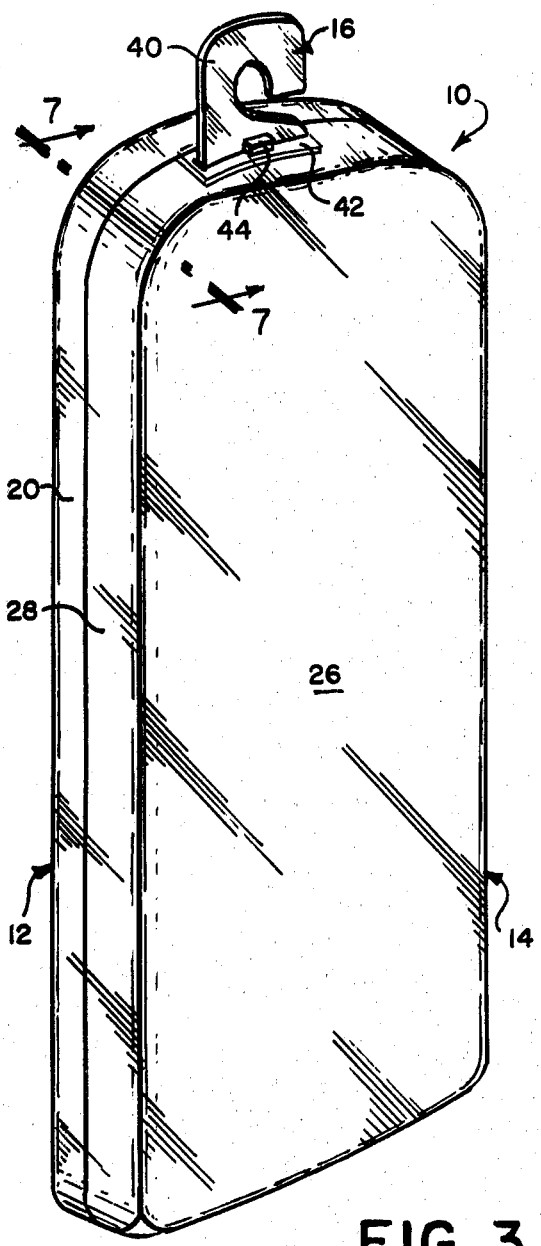
FIG. 1 is an elevational perspective view of the packaging device in accordance with the invention.

Referring now to the drawings, reference numeral 10 identifies the packaging device in accordance with the invention. As best seen in FIG. 1, such packaging device comprises a pair of complementary shells 12 and 14, adapted to be assembled together into closing engagement to define the packaging compartment therebetween, and a hanger member 16 removably securable to the assembled shells 12 and 14 in order to define means for suspending packaging device 10 from a hook or other similar projecting member.

Figure 8:
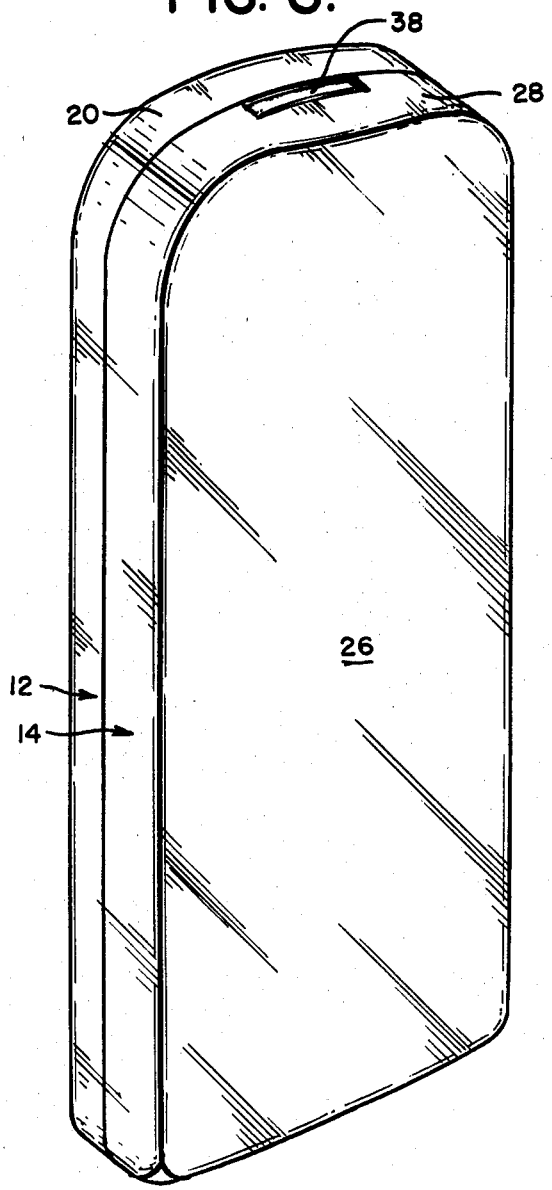
FIG. 8 is an elevational view of the packaging device without the hanger element incorporated therein.

The use of hanger member 16 is optional, and can be dispensed with if so desired by the ultimate user, in which event the packaging device 10 merely consists of assembled shells 12 and 14, as shown in FIG. 8.

Figure 2:
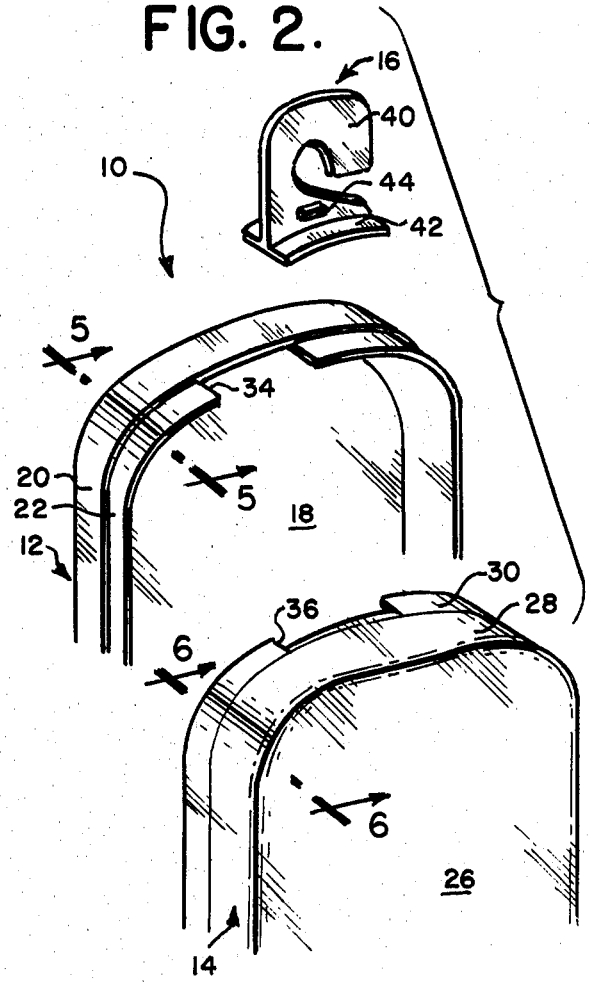
FIG. 2 is an exploded view of the three components forming part of said packaging device.
Figure 3:
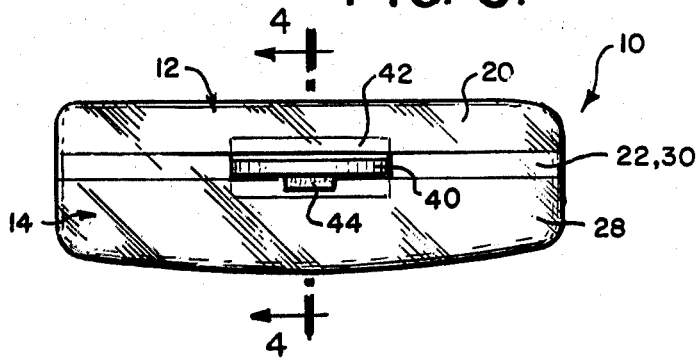
FIG. 3 is a top plan view of the packaging device shown in FIG. 1.
Figure 5:
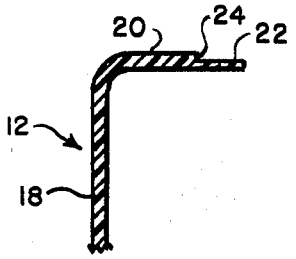
FIG. 5 is a sectional view taken along line 5—5 of FIG. 2.
Figure 6:
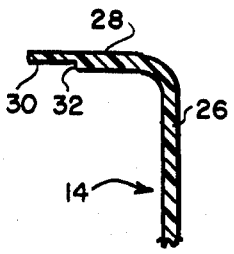
FIG. 6 is a sectional view taken along line 6—6 of FIG. 2.

As best shown in FIGS. 2 and 5, shell 12 comprises main body portion 18 provided with a peripheral skirt 20 terminating in inner end portion 22 or reduced thickness so as to define a peripheral shoulder 24. Similarly, shell 14 comprises main body portion 26 provided with a peripheral skirt 28 terminating in outer end portion 30 of reduced thickness so as to define peripheral shoulder 32. A cutout 34 is provided in the upper central portion of peripheral skirt 20 of shell 12, and a complementary cutout 36 is provided in the upper central portion of peripheral skirt 28 of shell 14.

Figure 7:
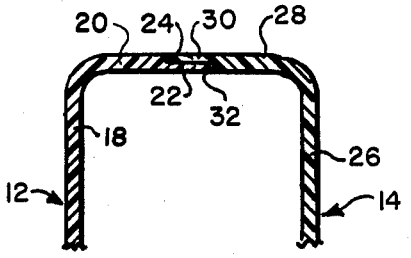
FIG. 7 is a sectional view taken along line 7—7 of FIG. 1.

As previously stated, shells 12 and 14 are complementary so that the two are assemblable together into closing engagement, as best shown in FIG. 7, with reduced thickness portions 22 and 30 in overlapping relation and in abutment against shoulders 32 and 24, respectively, to define a closed compartment within which an article being displayed and offered for sale is stored.

When the two shells are so assembled, as best shown in FIG. 8, cutouts 34 and 36 cooperate to define a narrow slot 38 which is substantially unnoticeable and thus does not interfere in any way with the overall aesthetic appearance of the packaging device. In that form, the packaging device can easily be stored and displayed in conventional racks wherein they are disposed either in a vertical or horizontal disposition.

In accordance with the invention, there is provided a hanger member 16 adapted to be removably secured to packaging device 10 in order to enable said packaging device to be suspended on a hook for convenient display thereof in vertical disposition, from which it can easily be removed for closer inspection and examination.

As best shown in FIG. 2, hanger element 16 comprises an upwardly extending hook shaped portion 40 and a generally horizontally extending base 42, conforming to the curvature of the upper central portions of peripheral skirts 20 and 28. In addition, at least one side of hook shaped portion 40 is provided with projection 44 vertically spaced from base 42.

Figure 4:
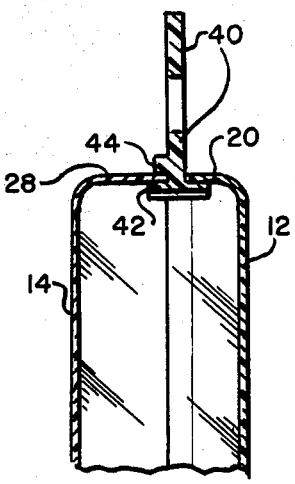
FIG. 4 is a sectional view taken along line 4—4 of FIG. 3.

Hanger element 16 is easily assembled into the packaging device by passing hook shaped portion 40 through cutouts 34 and 36 as the shells are assembled into closing engagement. As best shown in FIG. 4 such assembly will cause base 42 to be disposed immediately below the engaged peripheral skirts 20 and 28 with projection 44 being disposed immediately thereabove. The thickness of hook shaped portion 40 is just slightly smaller than the width of slot 38, and it will be apparent that when the entire packaging device is assembled with hanger element 16, the latter will be fixed in its intended position, since base 42 and projection 44 will prevent any vertical displacement of hanger element 16, so long as the packaging device remains closed. Conversely, if the hanger element 16 is no longer desired or needed, it can easily be removed by disengaging shells 12 and 14 from each other, after which the shells can again be assembled into closing engagement to define the conventional packaging device. Of course, if at any subsequent time it is desired to suspend the packaging device from a hook, the hanger element can easily be reattached in the manner previously described.

Shells 12 and 14 are preferably molded out of transparent plastic, so that the contents of the packaging device can easily be seen without opening the same. The hanger element 16 is preferably also made out of the same transparent plastic material and can usually be molded simultaneously with the molding of shells 12 and 14.

It will thus be seen that the packaging device aforedescribed is easily assemblable, with the hanger element, to enable the device to be suspended in vertical disposition. Alternatively, the hanger element can be dispensed with, leaving an unblemished aesthetically acceptable packaging device, if such is the form desired for displaying the goods.

Thus the subject packaging device provides the requisite flexibility without significantly affecting the overall cost of the packaging device.

It will also be noted that the consumer who purchases the article in question, in its packaging device, may easily remove the hanger element after purchasing, retaining an unblemished box which can be used for continued storage of the pair of gloves or other article involved.

While there is herein shown and described the preferred embodiments of the invention, it will be understood that the invention may be embodied otherwise than as herein specifically illustrated or described, and that in the illustrated embodiments certain changes in the details of construction and in the form and arrangement of parts may be made without departing from the underlying idea or principles of this invention within the scope of the appended claims.

Having thus described my invention, what I claim and desire to secure by Letters Patent is:

1. A packaging device comprising, (a) a pair of shells adapted to be assembled into closing engagement to define an enclosure for an article of merchandise, each of said shells comprising a main body portion and a peripheral skirt, and the uppermost portions of said peripheral skirts being in overlapping relation when said shells are in said closing engagement, (b) means defining a slot in the upper part of said enclosure, said means comprising a cutout in the upper central part of the peripheral skirt in each shell, and (c) a hanger element extending through said slot and releasably securable to said enclosure at said upper part thereof for suspending said enclosure from said hanger element.

2. A packaging device in accordance with claim 1, wherein means are provided on said hanger element for preventing the displacement of said hanger element when said shells are in said closing engagement.

3. A packaging device in accordance with claim 2, wherein said preventing means comprises a base and a projecting member positioned on opposite sides, respectively, of the slot, fixing said hanger element in position so long as said shells are in closing engagement.

* * * * *